US009447654B2

(12) United States Patent
Vick, Jr. et al.

(10) Patent No.: US 9,447,654 B2
(45) **Date of Patent: *Sep. 20, 2016**

(54) DOWNHOLE CIRCULATING VALVE HAVING A SEAL PLUG AND METHOD FOR OPERATING SAME

(71) Applicant: Halliburton Energy Services, Inc., Houston, TX (US)

(72) Inventors: James Dan Vick, Jr., Dallas, TX (US); Jimmie Robert Williamson, Carrollton, TX (US); Robert Lester Thurman, Frisco, TX (US); Russell Irving Bayh, III, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 648 days.

This patent is subject to a terminal disclaimer.

(21) Appl. No.: 13/750,180

(22) Filed: Jan. 25, 2013

(65) Prior Publication Data

US 2013/0284453 A1 Oct. 31, 2013

(51) Int. Cl.

| | |
|---|---|
| ***E21B 34/06*** | (2006.01) |
| ***E21B 23/04*** | (2006.01) |
| ***E21B 34/12*** | (2006.01) |
| ***E21B 34/14*** | (2006.01) |
| *E21B 33/00* | (2006.01) |

(52) U.S. Cl.

CPC ..... *E21B 34/06* (2013.01); *E21B 23/04* (2013.01); *E21B 34/12* (2013.01); *E21B 34/14* (2013.01); *E21B 2033/005* (2013.01)

(58) Field of Classification Search

CPC ..... E21B 2033/005; E21B 21/103; E21B 21/128; E21B 21/13; E21B 34/06; E21B 34/08; E21B 34/14; E21B 34/16; E21B 43/123

See application file for complete search history.

(56) References Cited

U.S. PATENT DOCUMENTS 4,011,906 A * 3/1977 Alexander ..... E21B 36/00 166/105
4,239,082 A 12/1980 Terral
4,360,064 A * 11/1982 O'Connor, III ..... E21B 34/10 166/319

(Continued)

OTHER PUBLICATIONS

International Search Report and Written Opinion, KIPO, PCT/US2012/035098, Dec. 18, 2012.

(Continued)

*Primary Examiner* — Blake Michener
*Assistant Examiner* — Christopher Sebesta
(74) *Attorney, Agent, or Firm* — Haynes and Boone, LLP

(57) ABSTRACT

A downhole circulating valve includes a generally tubular outer housing having a generally axially extending internal passageway. At least one generally longitudinally extending circulating passageway is formed through at least a portion of the housing. At least one exterior port and at least one interior port are in fluid communication with the circulating passageway. At least one seal plug is disposed within the circulating passageway. The seal plug has a first position relative to the housing wherein the seal plug is remote from the exterior port and the interior port, thereby allowing fluid flow between the exterior port and the interior port through the circulating passageway. The seal plug has a second position relative to the housing wherein the seal plug is between the exterior port and the interior port and wherein the seal plug forms at least one metal-to-metal seal with the circulating passageway, thereby preventing fluid flow between the exterior port and the interior port.

20 Claims, 9 Drawing Sheets

(56) References Cited

U.S. PATENT DOCUMENTS

| | | | | |
|---|---|---|---|---|
| 4,657,082 | A | 4/1987 | Ringgenberg | |
| 5,285,853 | A * | 2/1994 | Eckert | E21B 33/04 166/115 |
| 5,906,238 | A * | 5/1999 | Carmody | E21B 21/10 166/113 |
| 7,866,402 | B2 | 1/2011 | Williamson, Jr. | |
| 2005/0274528 | A1 * | 12/2005 | Hiron | E21B 34/08 166/373 |
| 2010/0108148 | A1 * | 5/2010 | Chen | E21B 34/08 137/2 |
| 2010/0224371 | A1 * | 9/2010 | Swan | E21B 21/103 166/373 |

OTHER PUBLICATIONS

Written Opinion issued by the Intellectual Property Office of Singapore regarding related Singapore Patent Application No. 112014067935, dated Nov. 3, 2015, 7 pages.

* cited by examiner

DOWNHOLE CIRCULATING VALVE HAVING A SEAL PLUG AND METHOD FOR OPERATING SAME

CROSS-REFERENCE TO RELATED APPLICATIONS

This application claims the benefit under 35 U.S.C. §119 of the filing date of International Application No. PCT/US2012/035098, filed Apr. 26, 2012. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole circulating valve having a seal plug that establishes a metal-to-metal seal in the non-circulating configuration of the downhole circulating valve and method for operating the downhole circulating valve from the circulating configuration to the non-circulating configuration.

BACKGROUND OF THE INVENTION

Without limiting the scope of the present invention, its background will be described with reference to operations performed in a subterranean well that traverses a fluid-bearing subterranean formation, as an example. Subterranean wellbores are generally filled with fluids that extend from the lower end of the wellbore to the earth's surface. During drilling and completions operations, a weighted column of fluid is usually present adjacent to each of the fluid-bearing formations intersected by the wellbore, so that the column of fluid may exert hydrostatic pressure on the formations sufficient to prevent uncontrolled flow of fluid from the formations into the wellbore, which uncontrolled flow of fluid could result in a blowout.

In order to transport fluid, tools, instruments and the like within the wellbore, it is common practice to utilize a tubular string, such as drill pipe or production tubing, to which tools and instruments may be attached and within which fluid may be flowed and tools and instruments may be conveyed. When such a tubular string is disposed within the wellbore, the fluid column within the wellbore may be effectively divided into multiple portions. For example, a first fluid column may be contained in an annulus defined by the area separating the outside surface of the tubular string from the inside surface of the wellbore or casing string. At the same time, a second fluid column may be contained within the interior of the tubular string. In such a configuration, tools, instruments and the like may be transported within the wellbore attached to or within the tubular string without disturbing the relationship between the fluid column in the annulus and the fluid-bearing formations intersected by the wellbore.

After completing the well, it is typically desirable to remove the weighted column of fluid from both the interior of the tubular string, if present, and the annulus above the uppermost packer. This may be achieved through the use of a circulating valve disposed within in the tubular string, which has a primary purpose of selectively permitting fluid flow between the interior of the tubular string and the annulus. For example, when it is desired to remove the weighted column of fluid from the annulus, a lighter fluid may be pumped from the earth's surface down through the tubular string and radially outwardly from the tubular string through the circulating valve into the annulus and then back to the earth's surface up through the annulus. Typically, such tubing conveyed circulating valves have a sliding sleeve that may be longitudinally shifted between circulating and non-circulating positions using wireline or slickline techniques. In the non-circulating position, conventional circulating valves typically utilize resilient materials such as elastomers for sealing between movable metal parts to prevent fluid communication between the interior of the tubular string and the annulus.

It has been found, however, that resilient sealing materials may deteriorate due to the harsh chemical, physical and thermal environment downhole. When such deterioration occurs, the seals may fail to prevent fluid communication between the interior of the tubular string and the annulus when a conventional circulating valve is in its non-circulating configuration. Accordingly, a need has arisen for an improved circulating valve that is operable to selectively permit fluid flow between the interior of the tubular string and the annulus. In addition, a need has arisen for such an improved circulating valve that does not rely on resilient sealing materials to prevent fluid communication between the interior of the tubular string and the annulus when the circulating valve is in its non-circulating configuration.

SUMMARY OF THE INVENTION

The present invention disclosed herein comprises an improved circulating valve that is operable to selectively permit fluid flow between the interior of a tubular string and the annulus between the tubular string and the wellbore. In addition, the improved circulating valve of the present invention does not rely on resilient sealing materials to prevent fluid communication between the interior of the tubular string and the annulus when the circulating valve is in its non-circulating configuration but instead utilizes a metal-to-metal seal to provide a long lasting, high-pressure seal.

In one aspect, the present invention is directed to a downhole circulating valve. The downhole circulating valve includes a generally tubular outer housing having a generally axially extending internal passageway. At least one generally longitudinally extending circulating passageway is formed through at least a portion of the housing. At least one exterior port and at least one interior port are in fluid communication with the circulating passageway. At least one seal plug is disposed within the circulating passageway. The seal plug has a first position relative to the housing wherein the seal plug is remote from the exterior port and the interior port, thereby allowing fluid flow between the exterior port and the interior port through the circulating passageway. The seal plug has a second position relative to the housing wherein the seal plug is between the exterior port and the interior port and forms at least one metal-to-metal seal with the circulating passageway, thereby preventing fluid flow between the exterior port and the interior port.

In one embodiment, the downhole circulating valve may include a piston that is at least partially disposed within the circulating passageway and is operably associated with the seal plug. In this embodiment, longitudinal shifting of the piston in a first direction operates the seal plug from the first position to the second position. In some embodiments, the seal plug may include at least one seal ring that forms a metal-to-metal seal with the circulating passageway when the seal plug is in the second position. In certain embodiments, the seal plug may form multiple metal-to-metal seals with the circulating passageway when the seal plug is in the second position. For example, in one embodiment, the seal plug may include a plurality of seal rings each forming a metal-to-metal seal with the circulating passageway when the seal plug is in the second position. In another embodiment, the seal plug may include a plug shell having a plurality of seal rings and a plug pin operable to be received within the plug shell to expand the seal rings to form metal-to-metal seals with the circulating passageway when the seal plug is in the second position.

In some embodiments, the downhole circulating valve may have multiple seal plugs disposed within the circulating passageway, each forming at least one metal-to-metal seal with the circulating passageway when the seal plugs are positioned between the exterior port and the interior port. In other embodiments, the downhole circulating valve may have multiple seal plugs disposed within the circulating passageway, each forming multiple metal-to-metal seals with the circulating passageway when the seal plugs are positioned between the exterior port and the interior port. In one embodiment, the downhole circulating valve may include a removable barrier disposed within a fluid flow path between the exterior port and the interior port to initially prevent fluid flow between the exterior port and the interior port.

In another aspect, the present invention is directed to a downhole circulating valve. The downhole circulating valve includes a generally tubular outer housing having a generally axially extending internal passageway. At least one generally longitudinally extending circulating passageway is formed through at least a portion of the housing. At least one exterior port and at least one interior port are in fluid communication with the circulating passageway to form a fluid flow path through the housing. At least one seal plug is disposed within the circulating passageway. The seal plug has a first position relative to the housing wherein the seal plug is remote from the exterior port and the interior port, thereby allowing fluid flow through the fluid flow path. The seal plug has a second position relative to the housing wherein the seal plug is between the exterior port and the interior port and forms at least one metal-to-metal seal with the circulating passageway, thereby preventing fluid flow through the fluid flow path. A piston is at least partially disposed within the circulating passageway and is operably associated with the seal plug. An actuator sleeve is slidably disposed within the internal passageway and is operably associated with the piston such that longitudinal shifting of the actuator sleeve in a first direction longitudinally shifts the piston in the first direction which operates the seal plug from the first position to the second position. A removable barrier is disposed within the fluid flow path to initially prevent fluid flow through the fluid flow path.

In a further aspect, the present invention is directed to a method for operating a downhole circulating valve. The method includes providing a circulating valve including a generally tubular outer housing having a generally axially extending internal passageway, at least one generally longitudinally extending circulating passageway formed through at least a portion of the housing, at least one exterior port in fluid communication with the circulating passageway, at least one interior port in fluid communication with the circulating passageway and at least one seal plug disposed within the circulating passageway; running the circulating valve into a wellbore on a tubular string; shifting the seal plug from a first position relative to the housing wherein the seal plug is remote from the exterior port and the interior port thereby allowing fluid flow between the exterior port and the interior port through the circulating passageway to a second position relative to the housing wherein the seal plug is between the exterior port and the interior port; and forming at least one metal-to-metal seal between the seal plug and the circulating passageway, thereby preventing fluid flow between the exterior port and the interior port.

The method may also include initially preventing fluid flow between the exterior port and the interior port with a removable barrier, initially preventing fluid flow between the exterior port and the interior port with a rupture disk and increasing a pressure signal acting on the rupture disk to burst the rupture disk and allow fluid flow between the exterior port and the interior port, forming multiple metal-to-metal seals between the seal plug and the circulating passageway, forming at least one metal-to-metal seal with each of a plurality of seal plugs and the circulating passageway, forming multiple metal-to-metal seals between each of a plurality of seal plugs and the circulating passageway and/or shifting the seal plug by one of mechanical actuation, electromechanical actuation and pressure actuation.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
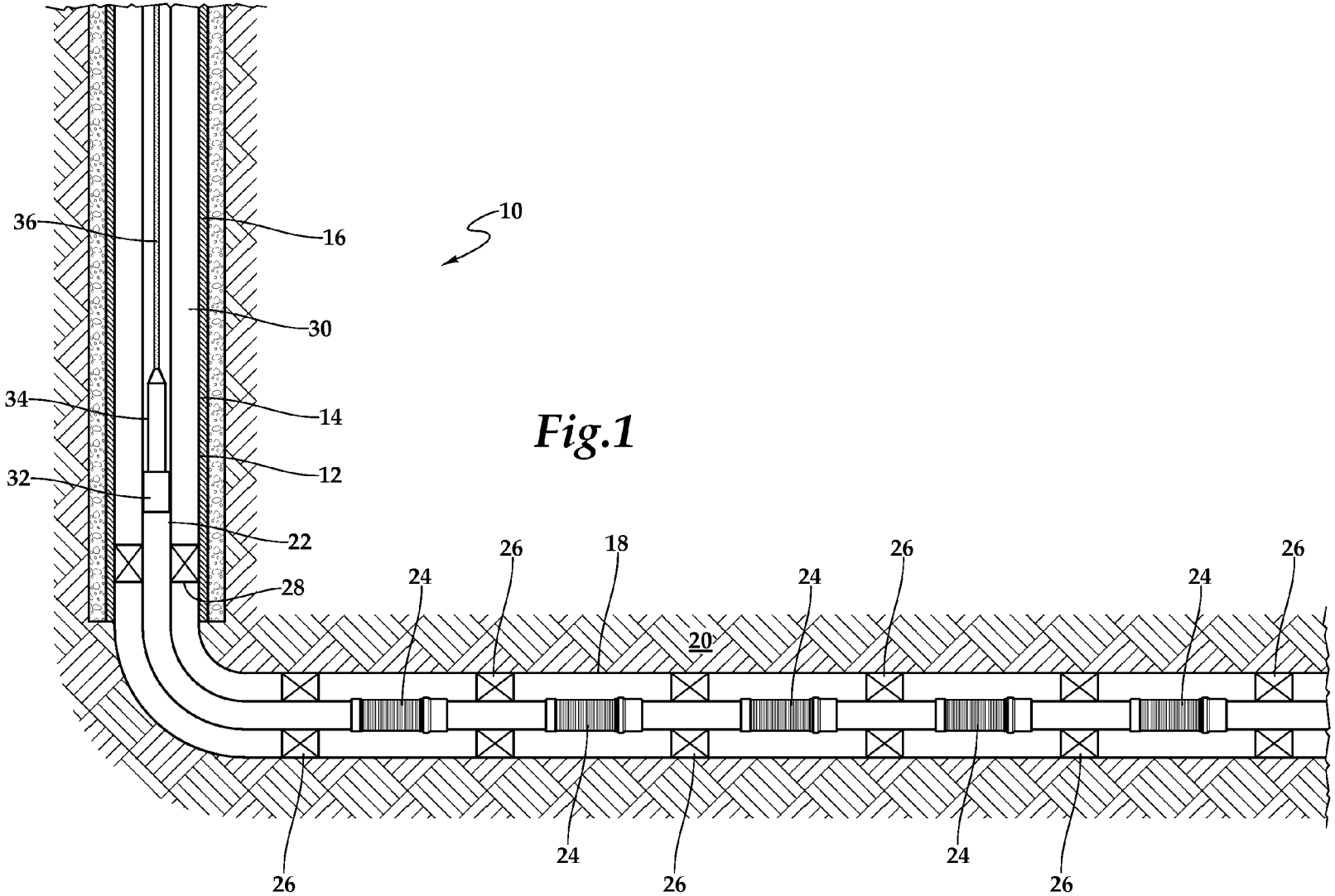
FIG. 1 is a schematic illustration of a well system operating a downhole circulating valve according to an embodiment of the present invention.

Referring initially to FIG. 1, therein is depicted a well system including a downhole circulating valve embodying principles of the present invention that is schematically illustrated and generally designated 10. In the illustrated embodiment, a wellbore 12 extends through the various earth strata. Wellbore 12 has a substantially vertical section 14, the upper portion of which has a casing string 16 cemented therein. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of sand control screens 24, each of which is positioned between a pair of annular barriers depicted as packers 26 that provides a fluid seal between the completion string and wellbore 12, thereby defining the production intervals. Tubing string 22 may include a variety of tools such as packer 28 that provides a seal between tubing string 22 and casing string 16. An annulus 30 is defined between tubing string 22 and casing string 16 above packer 28. As discussed above, during drilling and completions operations, a weighted column of fluid is usually present in the wellbore 12 to exert hydrostatic pressure on formation 20 sufficient to prevent uncontrolled flow of fluid from formation 20 into wellbore 12. To enable production, however, the weighted column of fluid must be removed from wellbore 12. In the illustrated embodiment, a circulating valve 32 is positioned within tubing string 22 above packer 28 and may be operated via a slickline or wireline deployed shifting tool 34 including, for example, a mechanical shifting or jarring tool, an electromechanical shifting tool such as a downhole power unit having an electrical motor and a movable shaft or similar shifting tool. Alternatively, a circulating valve of the present invention may be operated using pressure signals, such as via a hydraulic pressure system, hydrostatic pressure changes or localized pressure operations such as via pyrotechnics, combustible elements including thermite elements and the like. Circulating valve 32 serves the primary purpose of selectively permitting fluid flow between the interior of tubing string 22 and annulus 30.

Typically, circulating valve 32 is initially run downhole in a non-circulating configuration to prevent fluid flow between the interior of tubing string 22 and annulus 30. As described below, circulating valve 32 includes a removable barrier such as a rupture disk that initially prevents fluid flow between the interior of tubing string 22 and annulus 30. In the case of a rupture disk, a pressure signal may be used to burst the rupture disk when it is desired to operate circulating valve 32 from the initial non-circulating configuration to its circulating configuration. Thereafter, a lighter fluid may be pumped from the earth's surface down through tubing string 22 and radially outwardly from tubing string 22 through circulating valve 32 into annulus 30 and then back to the earth's surface up through annulus 30. After the weighted column of fluid is removed, shifting tool 34 deployed on conveyance 36 is used to operate circulating valve 32 from its circulating configuration to a non-circulating configuration. In the present invention, when circulating valve 32 is shifted to the non-circulating configuration, one or more metal-to-metal seals prevent fluid communication between the interior of tubing string 22 and annulus 30.

Even though FIG. 1 depicts the circulating valve of the present invention in a cased hole environment, it should be understood by those skilled in the art that the present invention is equally well suited for use in an open hole well. In addition, even though FIG. 1 depicts the circulating valve of the present invention in a vertical section of the wellbore, it should be understood by those skilled in the art that the present invention is equally well suited for use in wells having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
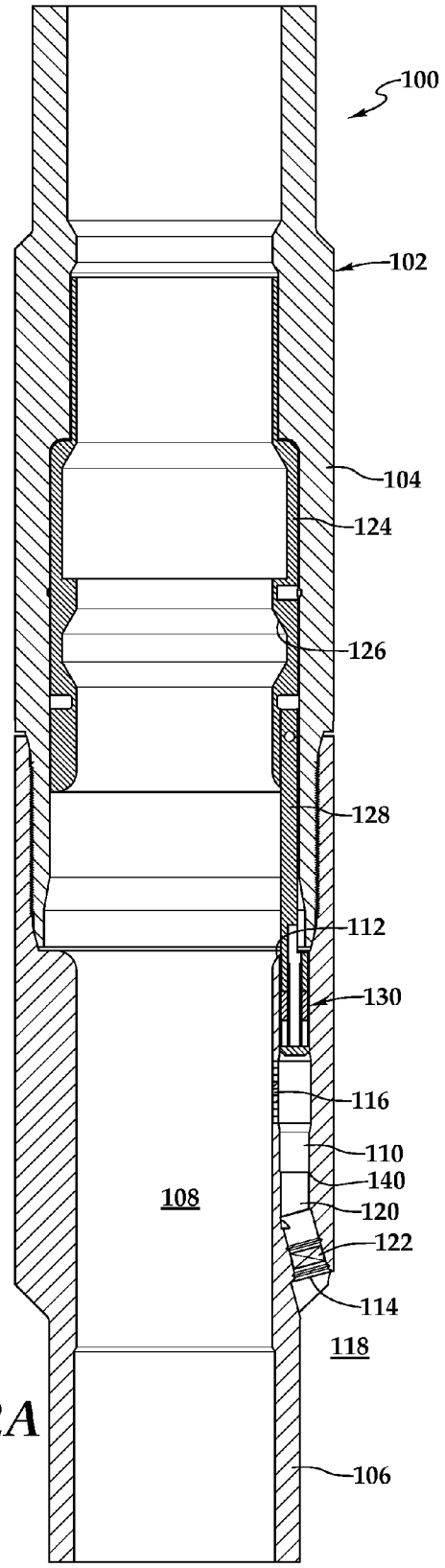
FIGS. 2A-2B are cross sectional views of a downhole circulating valve according to an embodiment of the present invention in its circulating configuration and its non-circulating configuration, respectively.
Figure 2B:
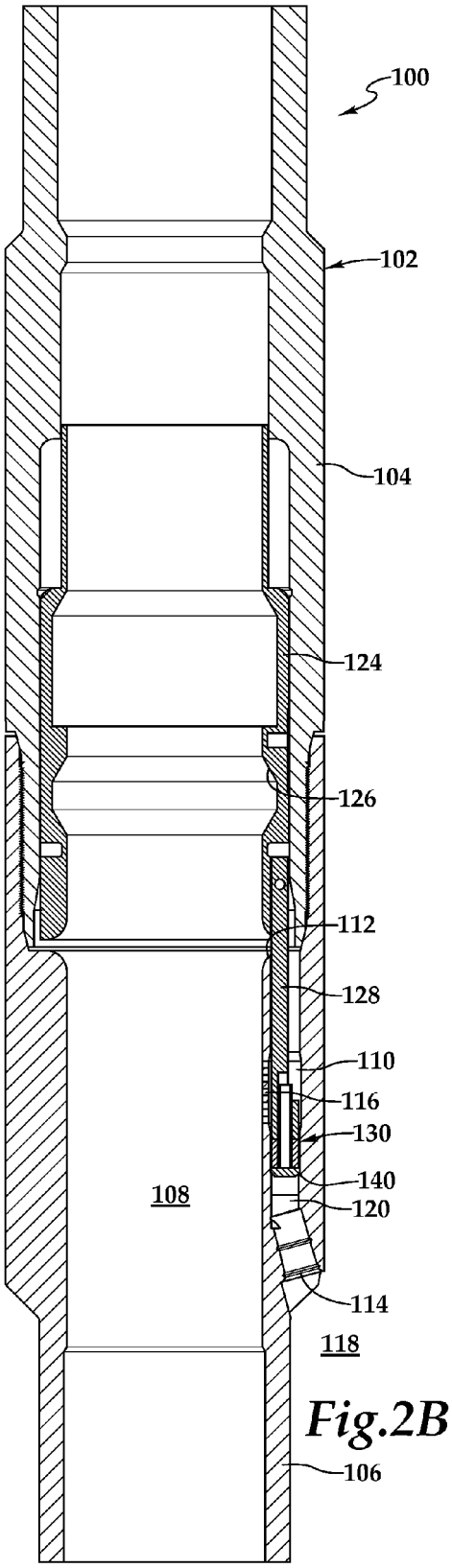

Referring next to FIGS. 2A-2B, therein is depicted a downhole circulating valve embodying principles of the present invention in its circulating configuration and its non-circulating configuration, respectively, that is generally designated 100. Circulating valve 100 has a generally tubular outer housing 102 including, in the illustrated embodiment, an upper housing section 104 and a lower housing section 106 that are threadably coupled together. Housing 102 is suitably adapted to be coupled to other downhole tools or tubulars to form a tubing string as described above. Housing 102 defines a generally axially extending internal passageway 108. Lower housing section 106 includes a generally longitudinally extending circulating passageway 110 that is formed through a portion of lower housing section 106. In the illustrated embodiment, circulating passageway 110 is a generally cylindrically shaped passageway extending between an upper opening 112 and an exterior port 114. In addition, lower housing section 106 includes a plurality of interior ports 116 that provide fluid communication between internal passageway 108 and circulating passageway 110. Together, exterior port 114, interior ports 116 and circulating passageway 110 form a fluid flow path 120 between internal passageway 108 and an annulus 118 surrounding housing 102. Even though a single circulating passageway 110 is depicted and described, it should be understood by those skilled in the art that circulating valve 100 could alternatively have multiple circulating passageways without departing from the principles of the present invention. Circulating valve 100 may include an optional removable barrier 122 positioned within fluid flow path 120 to initially prevent fluid flow between exterior port 114 and interior ports 116. Removable barrier 122 may be a pressure actuated device such as a rupture disk, a temperature actuated device such as degradable polymer, an electrically actuated device such as a solenoid valve or the like.

Figure 2C:
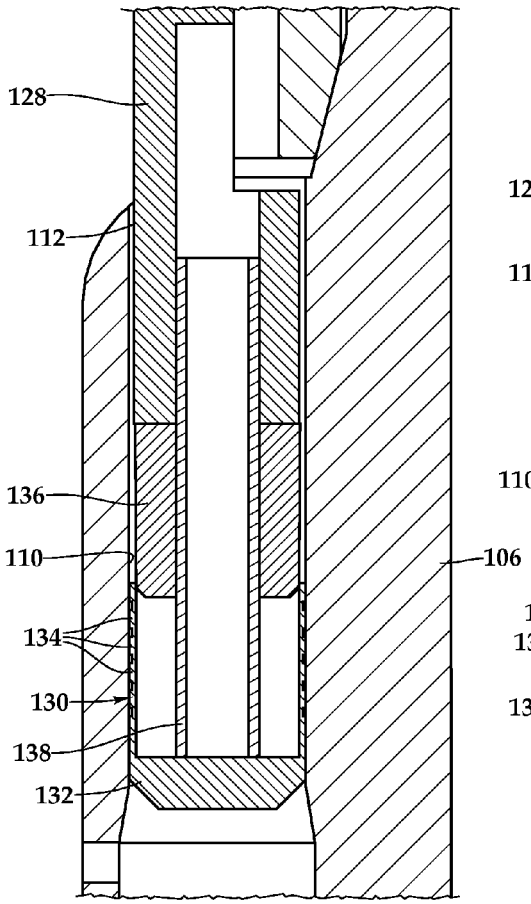
FIG. 2C is an enlarged view of a seal plug positioned in a downhole circulating valve in its circulating configuration according to an embodiment of the present invention.

An actuator sleeve 124 is slidably disposed within internal passageway 108 and is longitudinally shiftable relative to housing 102. Actuator sleeve 124 has a receiving profile 126 that is operable to be engaged by and cooperate with a shifting tool that may be run downhole on a conveyance such as a wireline or slickline as described above. A piston 128 is positioned within internal passageway 108 and extends into circulating passageway 110. Piston 128 is operatively associated with actuator sleeve 124 and may be coupled thereto via a pin connection or other suitable coupling assembly. Even though piston 128 is depicted as a rod piston, it should be understood by those skilled in the art that piston 128 could alternatively be an annular piston without departing from the principles of the present invention. A seal plug 130 is positioned within circulating passageway 110. As best seen in FIG. 2C, seal plug 130 includes a generally cylindrical plug shell 132 having a thin walled section including a plurality of annular grooves forming a plurality of annular lands referred to herein as seal rings 134. Seal plug 130 also includes a generally cylindrical plug pin 136 that is operable to be slidably received in plug shell 132. Plug pin 136 is also slidably received about a plug sleeve 138 disposed within plug shell 132. Preferably, plug pin 136 has an interference fit with plug sleeve 138 or may be coupled thereto with a bonding agent to prevent premature setting of seal plug 130. Plug pin 136 may have a slight taper to aid in insertion of plug pin 136 into plug shell 132 and to enable expansion of seal rings 134 as plug pin 136 is inserted into plug shell 132, as described below.

Figure 2D:
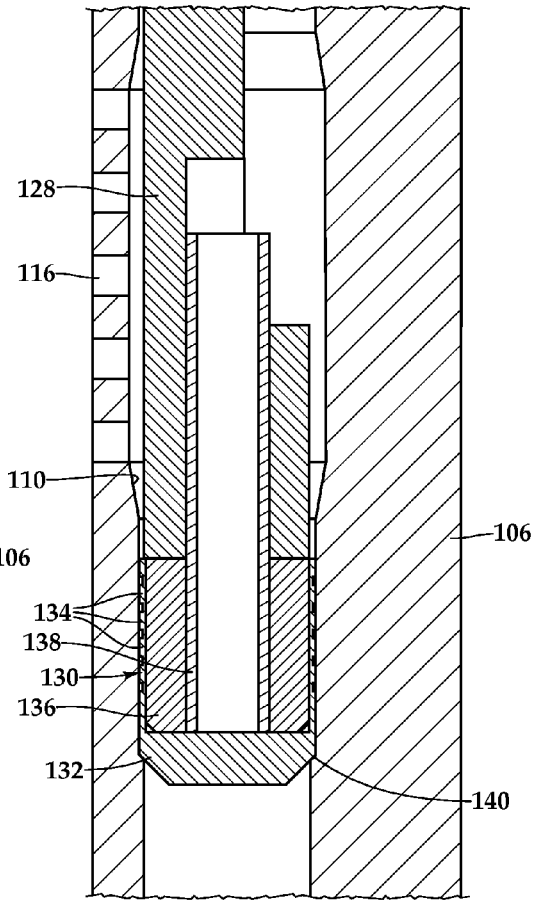
FIG. 2D is an enlarged view of a seal plug forming a metal-to-metal seal in a downhole circulating valve in its non-circulating configuration according to an embodiment of the present invention.

In operation, after circulating valve 100 has been run downhole as part of a tubing string and it is desired to circulate fluid between internal passageway 108 and annulus 118, removable barrier 122, if present, may be actuated. For example, in the case of a rupture disk, a pressure signal may be used to burst the rupture disk to disable the removable barrier 122. Thereafter, a fluid may be pumped from the earth's surface down through the tubing string into internal passageway 108, through fluid flow path 120 and into annulus 118 for return to the surface. When it is desired to operate circulating valve 100 from the circulating configuration (FIG. 2A) to the non-circulating configuration (FIG. 2B), a shifting tool, such as a wireline conveyed shifting tool, engages with receiving profile 126 of actuator sleeve 124. The shifting tool may then be used to downwardly shift actuator sleeve 124 which causes piston 128 to shift downwardly. The downward shifting of piston 128 drives seal plug 130 through circulating passageway 110 until plug shell 132 contacts annular shoulder 140 of circulating passageway 110 such that seal plug 130 is in a position between exterior port 114 and interior ports 116 in fluid flow path 120. As best seen in FIG. 2D, further downward movement of piston 128 shifts plug pin 136 down plug sleeve 138 and into plug shell 132 which causes the expansion of seal rings 134 forming a plurality of metal-to-metal seals with circulating passageway 110, thereby preventing fluid flow through fluid flow path 120. Thereafter, the shifting tool may be released from circulating valve 100 for retrieval to the surface.

Figure 3A:
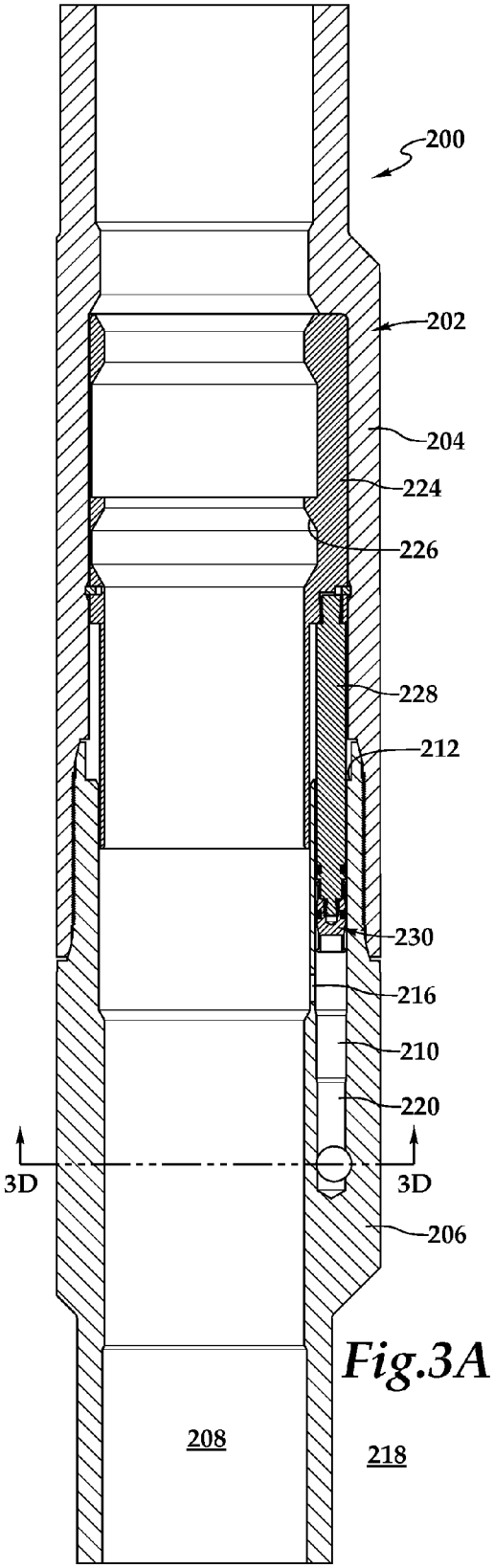
FIGS. 3A-3B are cross sectional views of a downhole circulating valve according to an embodiment of the present invention in its circulating configuration and its non-circulating configuration, respectively.
Figure 3B:
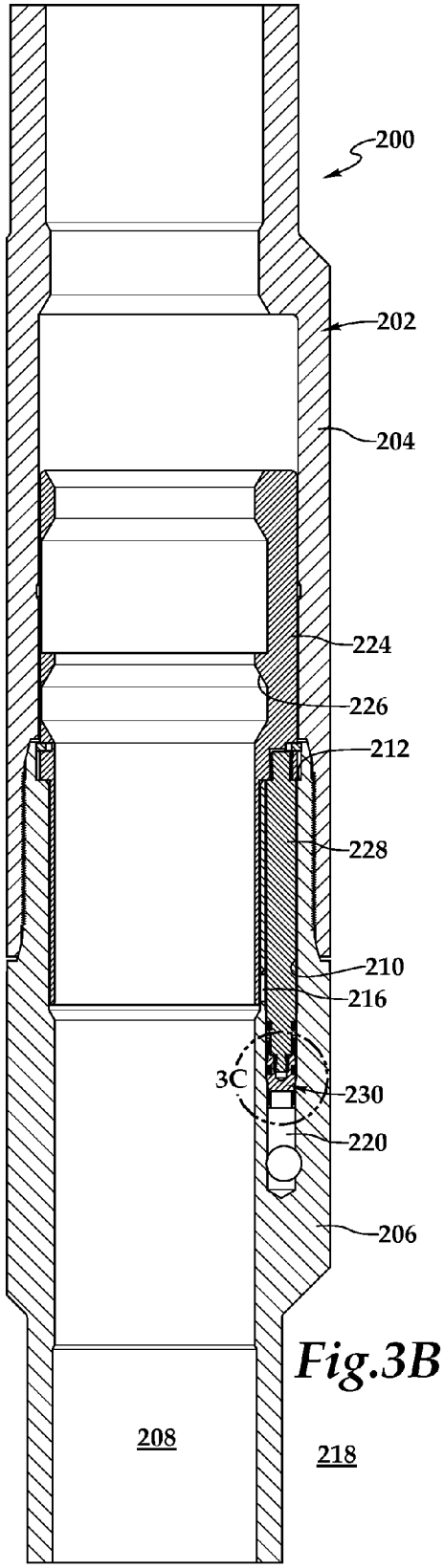
Figure 3C:
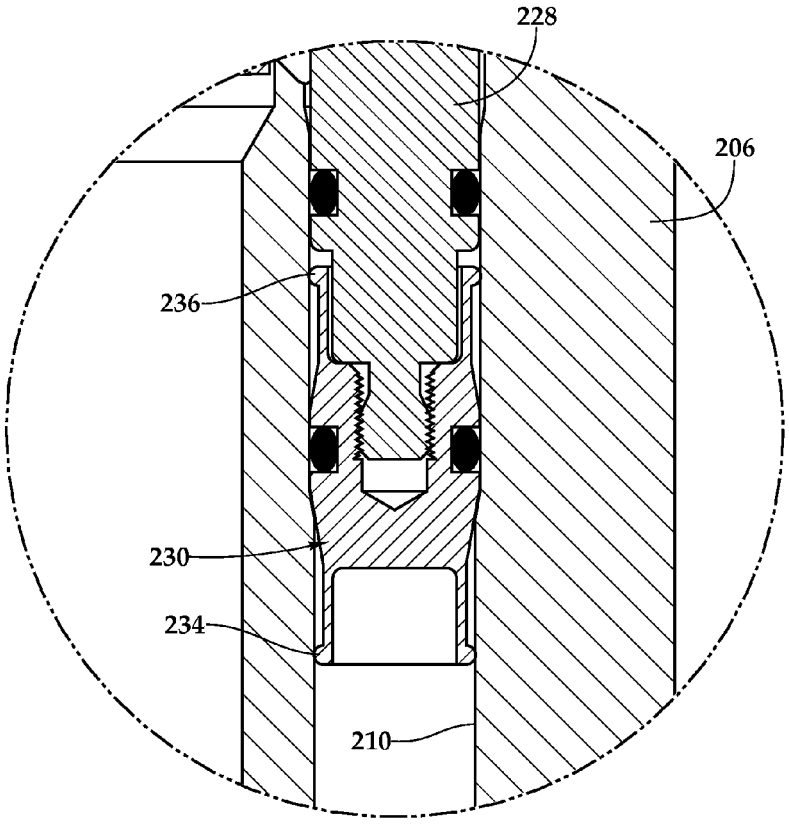
FIG. 3C is an enlarged view of a seal plug forming a metal-to-metal seal in a downhole circulating valve in its non-circulating configuration according to an embodiment of the present invention.
Figure 3D:
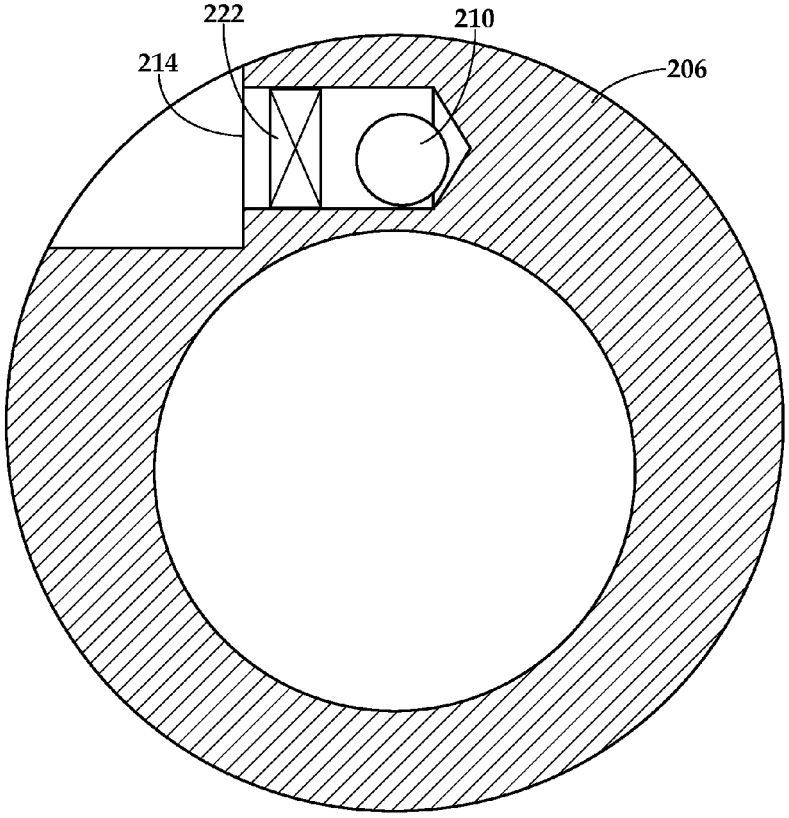
FIG. 3D is a cross sectional view of the downhole circulating valve in FIG. 3A taken along line 3D-3D.

Referring next to FIGS. 3A-3B, therein is depicted a downhole circulating valve embodying principles of the present invention in its circulating configuration and its non-circulating configuration, respectively, that is generally designated 200. Circulating valve 200 has a generally tubular outer housing 202 including, in the illustrated embodiment, an upper housing section 204 and a lower housing section 206 that are threadably coupled together. Housing 202 is suitably adapted to be coupled to other downhole tools or tubulars to form a tubing string as described above. Housing 202 defines a generally axially extending internal passageway 208. Lower housing section 206 includes a generally longitudinally extending circulating passageway 210 that is formed through a portion of lower housing section 206. In the illustrated embodiment, circulating passageway 210 is a generally cylindrically shaped passageway extending between an upper opening 212 and an exterior port 214, as best seen in FIG. 3D. In addition, lower housing section 206 includes an interior port 216 that provides fluid communication between internal passageway 208 and circulating passageway 210. Together, exterior port 214, interior port 216 and circulating passageway 210 form a fluid flow path 220 between internal passageway 208 and an annulus 218 surrounding housing 202. Circulating valve 200 may include an optional removable barrier 222 (FIG. 3D) positioned within fluid flow path 220 to initially prevent fluid flow between exterior port 214 and interior ports 216.

An actuator sleeve 224 is slidably disposed within internal passageway 208 and is longitudinally shiftable relative to housing 202. Actuator sleeve 224 has a receiving profile 226 that is operable to be engaged by and cooperate with a shifting tool that may be run downhole on a conveyance such as a wireline or slickline as described above. A piston 228 is positioned within internal passageway 208 and extends into circulating passageway 210. Piston 228 is operatively associated with actuator sleeve 224 and may be coupled thereto via a pin connection or other suitable coupling assembly. A seal plug 230 is positioned within circulating passageway 210. As best seen in FIG. 3C, seal plug 230 includes a pair of seal rings 234, 236 that are operably to form metal-to-metal seals with circulating passageway 210.

In operation, after circulating valve 200 has been run downhole as part of a tubing string and it is desired to circulate fluid between internal passageway 208 and annulus 218, removable barrier 222, if present, may be actuated. Thereafter, a fluid may be pumped from the earth's surface down through the tubing string into internal passageway 208, through fluid flow path 220 and into annulus 218 for return to the surface. When it is desired to operate circulating valve 200 from the circulating configuration (FIG. 3A) to the non-circulating configuration (FIG. 3B), a shifting tool, such as a wireline conveyed shifting tool, engages with receiving profile 226 of actuator sleeve 224. The shifting tool may then be used to downwardly shift actuator sleeve 224, which causes piston 228 to shift downwardly. The downward shifting of piston 228 drives seal plug 230 downwardly through circulating passageway 210 to a position between exterior port 214 and interior ports 216 in fluid flow path 220. As best seen in FIG. 3C, seal rings 234, 236 each form a metal-to-metal seal with circulating passageway 210, thereby preventing fluid flow through fluid flow path 220. When desired, upward jarring will release the shifting tool from circulating valve 200 for retrieval to the surface.

Figure 4A:
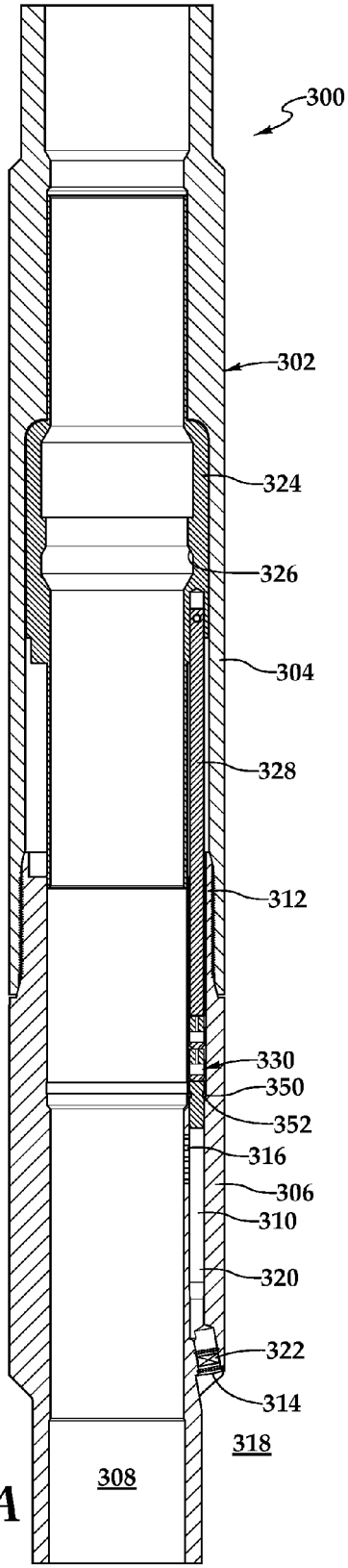
FIGS. 4A-4B are cross sectional views of a downhole circulating valve according to an embodiment of the present invention in its circulating configuration and its non-circulating configuration, respectively.
Figure 4B:
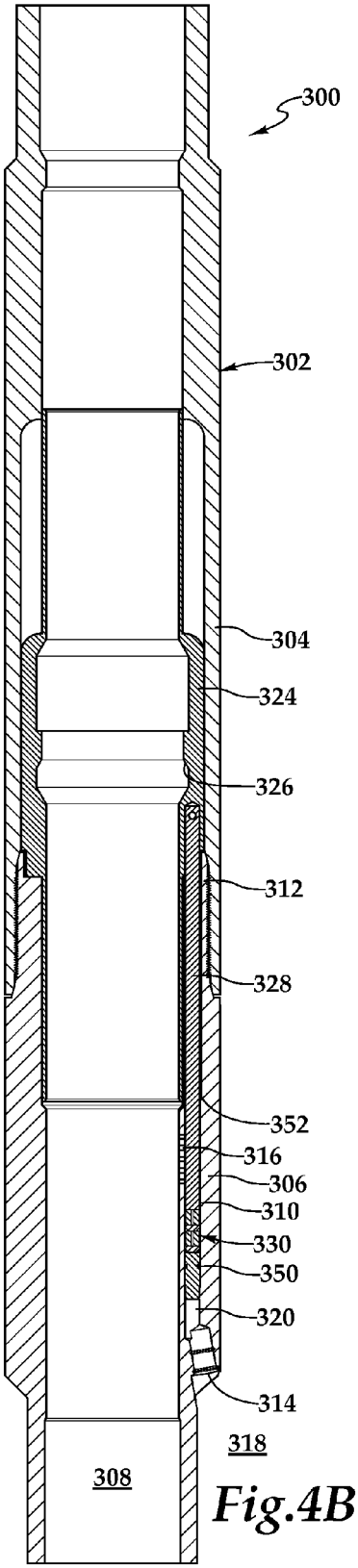

Referring next to FIGS. 4A-4B, therein is depicted a downhole circulating valve embodying principles of the present invention in its circulating configuration and its non-circulating configuration, respectively, that is generally designated 300. Circulating valve 300 has a generally tubular outer housing 302 including, in the illustrated embodiment, an upper housing section 304 and a lower housing section 306 that are threadably coupled together. Housing 302 is suitably adapted to be coupled to other downhole tools or tubulars to form a tubing string as described above. Housing 302 defines a generally axially extending internal passageway 308. Lower housing section 306 includes a generally longitudinally extending circulating passageway 310 that is formed through a portion of lower housing section 306. In the illustrated embodiment, circulating passageway 310 is a generally cylindrically shaped passageway extending between an upper opening 312 and an exterior port 314. In addition, lower housing section 306 includes a plurality of interior ports 316 that provide fluid communication between internal passageway 308 and circulating passageway 310. Together, exterior port 314, interior ports 316 and circulating passageway 310 form a fluid flow path 320 between internal passageway 308 and an annulus 318 surrounding housing 302. Circulating valve 300 may include an optional removable barrier 322 positioned within fluid flow path 320 to initially prevent fluid flow between exterior port 314 and interior ports 316.

Figure 4C:
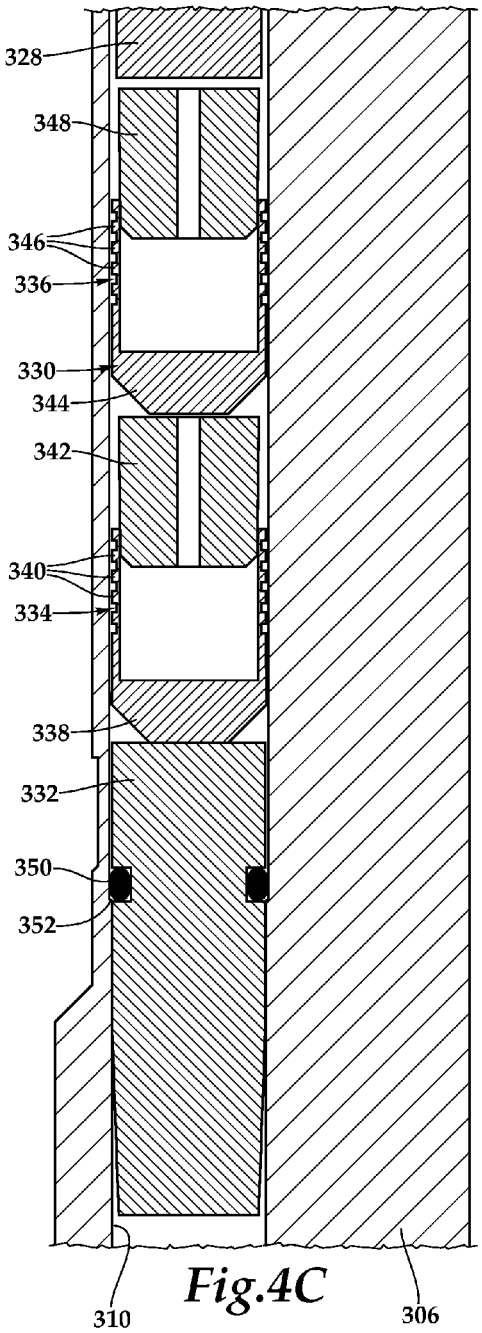
FIGS. 4C-4D are enlarged views of a seal assembly positioned in a downhole circulating valve in its circulating configuration and its non-circulating configuration, respectively, according to an embodiment of the present invention.

An actuator sleeve 324 is slidably disposed within internal passageway 308 and is longitudinally shiftable relative to housing 302. Actuator sleeve 324 has a receiving profile 326 that is operable to be engaged by and cooperate with a shifting tool that may be run downhole on a conveyance such as a wireline or slickline as described above. A piston 328 is positioned within internal passageway 308 and extends into circulating passageway 310. Piston 328 is operatively associated with actuator sleeve 324 and may be coupled thereto via a pin connection or other suitable coupling assembly. A seal assembly 330 is positioned within circulating passageway 310. As best seen in FIG. 4C, seal assembly 330 includes a solid plug 332 and a pair of seal plugs 334, 336. Seal plug 334 includes a generally cylindrical plug shell 338 having a thin walled section including a plurality of seal rings 340. Seal plug 334 also includes a generally cylindrical plug pin 342 that is operable to be slidably received in plug shell 338. Plug pin 342 may have a slight taper to aid in insertion of plug pin 342 into plug shell 338 and to enable expansion of seal rings 340 as plug pin 342 is inserted into plug shell 338. Plug pin 342 is coupled to plug shell 338 with a bonding agent to prevent premature setting of seal plug 334. Likewise, seal plug 336 includes a generally cylindrical plug shell 344 having a thin walled section including a plurality of seal rings 346. Seal plug 336 also includes a generally cylindrical plug pin 348 that is operable to be slidably received in plug shell 344. Plug pin 348 may have a slight taper to aid in insertion of plug pin 348 into plug shell 344 and to enable expansion of seal rings 346 as plug pin 348 is inserted into plug shell 344. Plug pin 348 is coupled to plug shell 344 with a bonding agent to prevent premature setting of seal plug 336. Preferably, the force required to break the bond between plug pin 348 and plug shell 344 is greater than the force required to break the bond between plug pin 342 and plug shell 338 to enable setting of seal plug 336 prior to setting of seal plug 330 as described below. An o-ring 350 is positioned around solid plug 332 and is initially supported against annular shoulder 352 of circulating passageway 310.

Figure 4D:
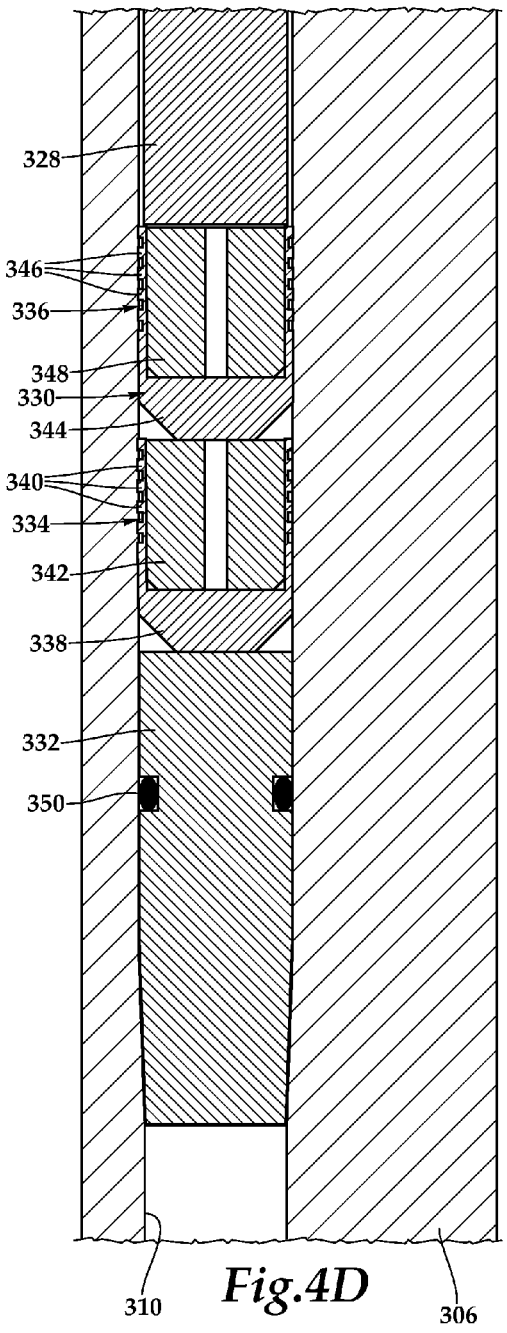

In operation, after circulating valve 300 has been run downhole as part of a tubing string and it is desired to circulate fluid between internal passageway 308 and annulus 318, removable barrier 322, if present, may be actuated. Thereafter, a fluid may be pumped from the earth's surface down through the tubing string into internal passageway 308, through fluid flow path 320 and into annulus 318 for return to the surface. When it is desired to operate circulating valve 300 from the circulating configuration (FIG. 4A) to the non-circulating configuration (FIG. 4B), a shifting tool, such as a wireline conveyed shifting tool, engages with receiving profile 326 of actuator sleeve 324. The shifting tool may then be used to downwardly shift actuator sleeve 324 which causes piston 328 to shift downwardly. The downward shifting of piston 328 drives seal assembly 330 downwardly through circulating passageway 310 to a position between exterior port 314 and interior ports 316 in fluid flow path 320 wherein a lowered tapered end of solid plug 332 contacts a tapered surface of circulating passageway 310. As best seen in FIG. 4D, further downward movement of piston 328 initially drives plug pin 342 into plug shell 338 which causes the expansion of seal rings 340 then drives plug pin 348 into plug shell 344 which causes the expansion of seal rings 346 forming a plurality of metal-to-metal seals with circulating passageway 310, thereby preventing fluid flow through fluid flow path 320. When desired, upward jarring will release the shifting tool from circulating valve 300 for retrieval to the surface.

Figure 5A:
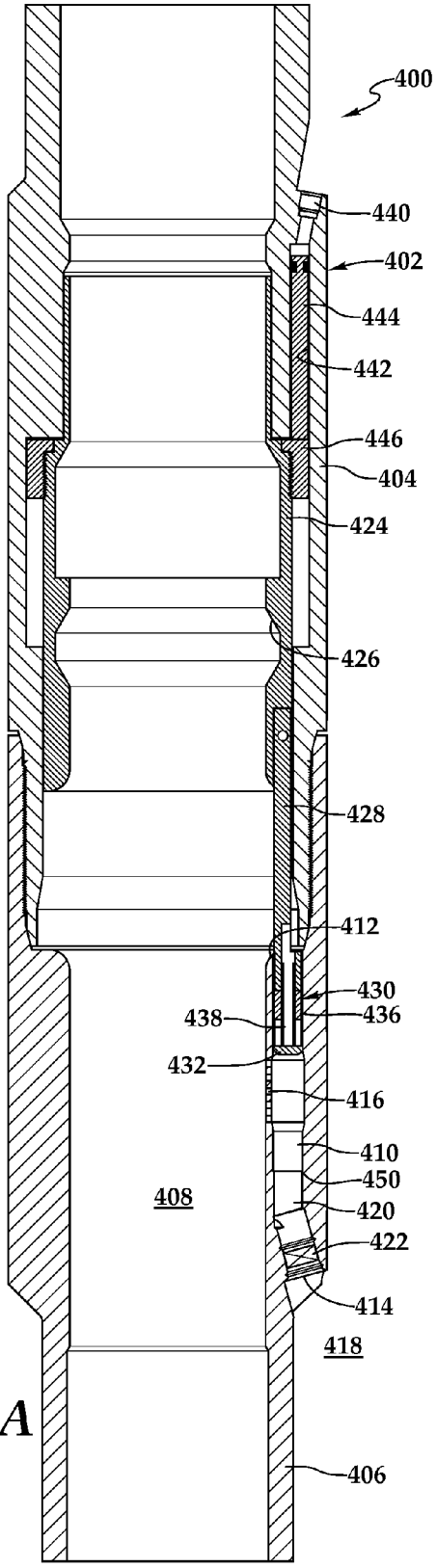
FIGS. 5A-5B are cross sectional views of a downhole circulating valve according to an embodiment of the present invention in its circulating configuration and its non-circulating configuration, respectively.
Figure 5B:
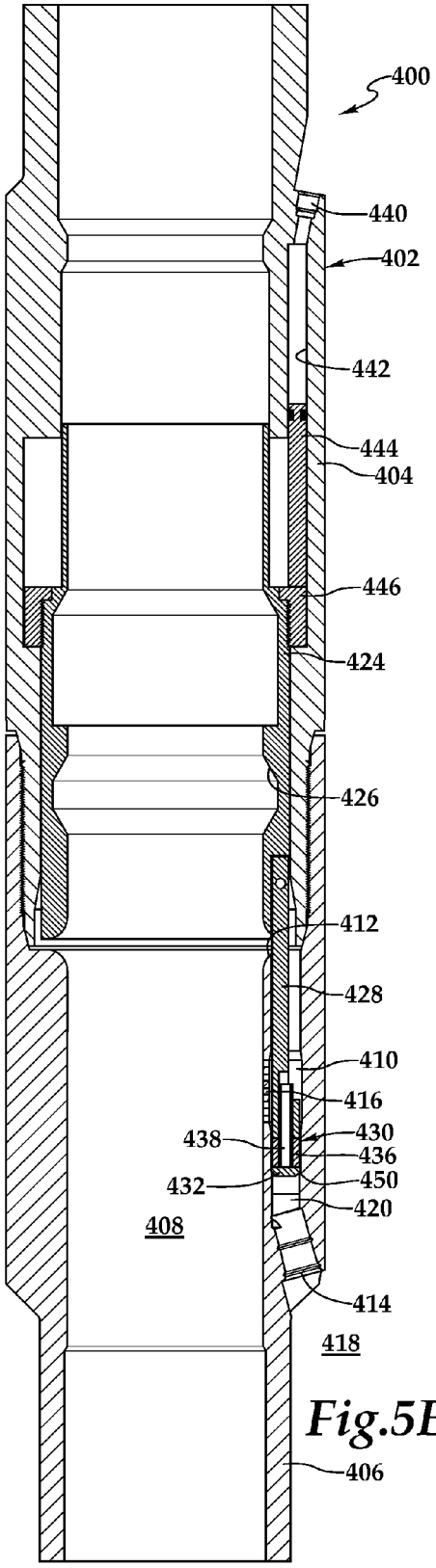

Referring next to FIGS. 5A-5B, therein is depicted a downhole circulating valve embodying principles of the present invention in its circulating configuration and its non-circulating configuration, respectively, that is generally designated 400. Circulating valve 400 has a generally tubular outer housing 402 including, in the illustrated embodiment, an upper housing section 404 and a lower housing section 406 that are threadably coupled together. Housing 402 is suitably adapted to be coupled to other downhole tools or tubulars to form a tubing string as described above. Housing 402 defines a generally axially extending internal passageway 408. Lower housing section 406 includes a generally longitudinally extending circulating passageway 410 that is formed through a portion of lower housing section 406. In the illustrated embodiment, circulating passageway 410 is a generally cylindrically shaped passageway extending between an upper opening 412 and an exterior port 414. In addition, lower housing section 406 includes a plurality of interior ports 416 that provide fluid communication between internal passageway 408 and circulating passageway 410. Together, exterior port 414, interior ports 416 and circulating passageway 410 form a fluid flow path 420 between internal passageway 408 and an annulus 418 surrounding housing 402. Circulating valve 400 may include an optional removable barrier 422 positioned within fluid flow path 420 to initially prevent fluid flow between exterior port 414 and interior ports 416.

An actuator sleeve 424 is slidably disposed within internal passageway 408 and is longitudinally shiftable relative to housing 402. Actuator sleeve 424 has a receiving profile 426 that is operable to be engaged by and cooperate with a shifting tool that may be run downhole on a conveyance such as a wireline or slickline as described above. A piston 428 is positioned within internal passageway 408 and extends into circulating passageway 410. Piston 428 is operatively associated with actuator sleeve 424 and may be coupled thereto via a pin connection or other suitable coupling assembly. A seal plug 430 is positioned within circulating passageway 410. Seal plug 430 includes a generally cylindrical plug shell 432 having a thin walled section including a plurality of annular grooves forming a plurality of annular lands referred to herein as seal rings as described above. Seal plug 430 also includes a generally cylindrical plug pin 436 that is operable to be slidably received in plug shell 432. Plug pin 436 is also slidably received about a plug sleeve 438 disposed within plug shell 432. Preferably, plug pin 436 has an interference fit with plug sleeve 438 or may be coupled thereto with a bonding agent to prevent premature setting of seal plug 430. Plug pin 436 may have a slight taper to aid in insertion of plug pin 436 into plug shell 432 and to enable expansion of the seal rings as plug pin 436 is inserted into plug shell 432, as described below.

In addition to being mechanically operable, circulating valve 400 may be operated using pressure signals. In the illustrated embodiment, upper housing section 404 includes a hydraulic port 440 that is operable to be connected to a hydraulic line (not pictured) that may run from circulating valve 400 to a surface hydraulic facility. Upper housing section 404 also includes a hydraulic fluid passageway 442. A rod piston 444 is slidably and sealing disposed within hydraulic fluid passageway 442. Piston 444 is operably associated with a piston shoulder 446 that is threadably coupled to actuator sleeve 424. It should be understood by those skilled in the art that in a pressure operated circulating valve, an actuator sleeve is not required. Accordingly, in the present embodiment, piston 444, actuator sleeve 424 and piston 428 may be considered to be a single pressure actuated piston.

In operation, after circulating valve 400 has been run downhole as part of a tubing string and it is desired to circulate fluid between internal passageway 408 and annulus 418, removable barrier 422, if present, may be actuated. Thereafter, a fluid may be pumped from the earth's surface down through the tubing string into internal passageway 408, through fluid flow path 420 and into annulus 418 for return to the surface. When it is desired to operate circulating valve 400 from the circulating configuration (FIG. 5A) to the non-circulating configuration (FIG. 5B), hydraulic pressure may be increased with the hydraulic system such that the hydraulic fluid acts on piston 444. Downward movement of piston 444 downwardly shifts actuator sleeve 424 which causes piston 428 to shift downwardly. The downward shifting of piston 428 drives seal plug 430 through circulating passageway 410 until plug shell 432 contacts annular shoulder 450 of circulating passageway 410 such that seal plug 430 is in a position between exterior port 414 and interior ports 416 in fluid flow path 420. Further downward movement of piston 428 shifts plug pin 436 down plug sleeve 438 and into plug shell 432 which causes the expansion of the seal rings forming a plurality of metal-to-metal seals with circulating passageway 410, thereby preventing fluid flow through fluid flow path 420. Once seal plug 430 is set, hydraulic pressure may be released.

Figure 6A:
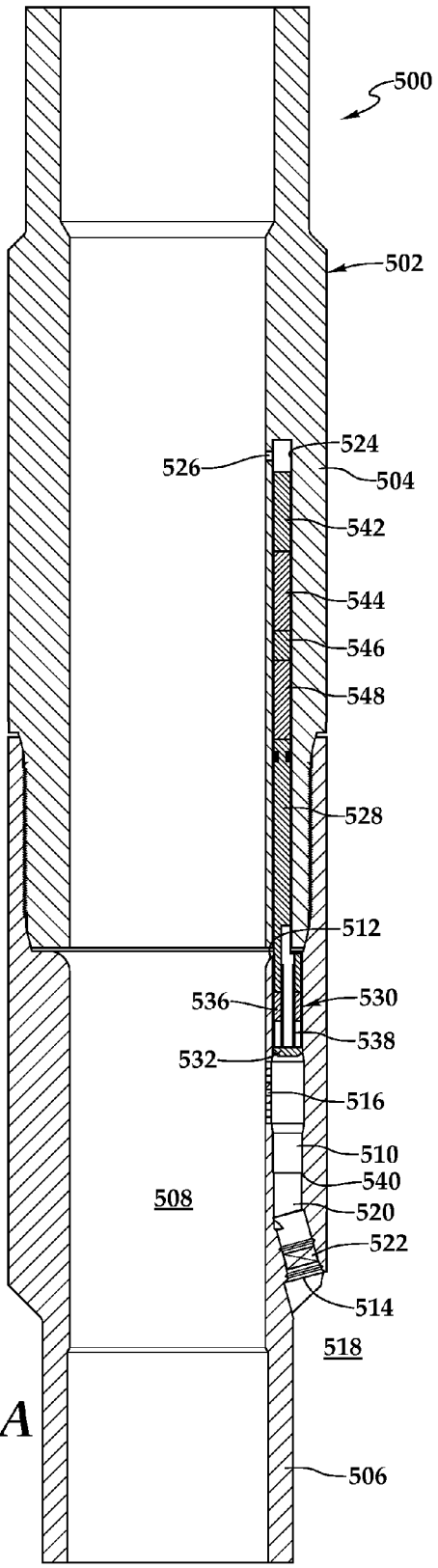
FIGS. 6A-6B are cross sectional views of a downhole circulating valve according to an embodiment of the present invention in its circulating configuration and its non-circulating configuration, respectively.
Figure 6B:
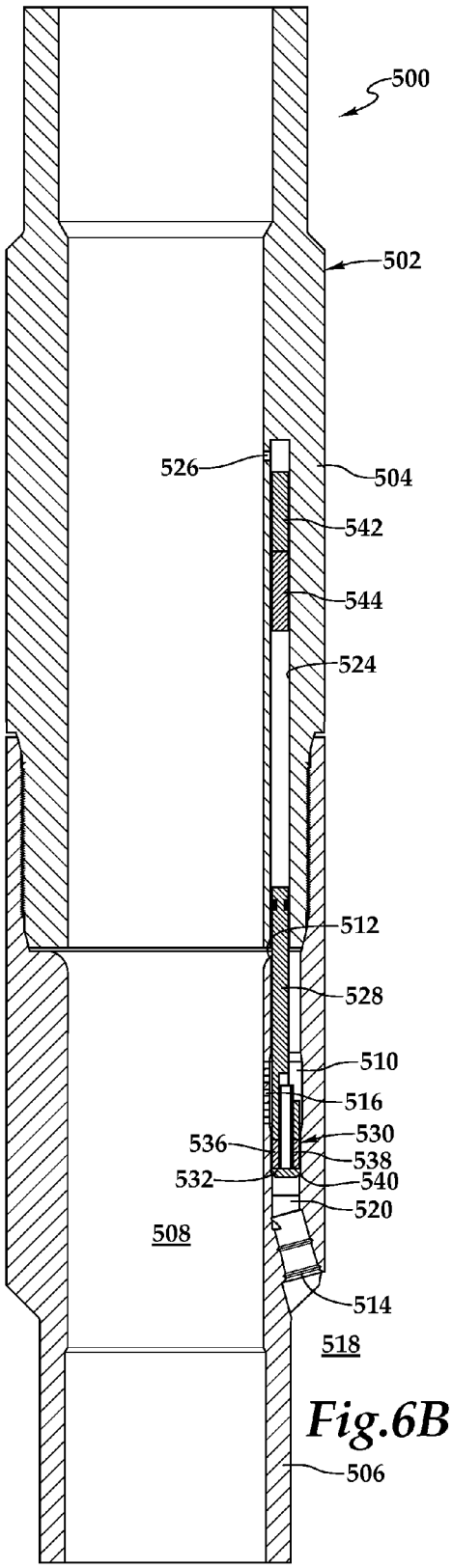

Referring next to FIGS. 6A-6B, therein is depicted a downhole circulating valve embodying principles of the present invention in its circulating configuration and its non-circulating configuration, respectively, that is generally designated 500. Circulating valve 500 has a generally tubular outer housing 502 including, in the illustrated embodiment, an upper housing section 504 and a lower housing section 506 that are threadably coupled together. Housing 502 is suitably adapted to be coupled to other downhole tools or tubulars to form a tubing string as described above. Housing 502 defines a generally axially extending internal passageway 508. Lower housing section 506 includes a generally longitudinally extending circulating passageway 510 that is formed through a portion of lower housing section 506. In the illustrated embodiment, circulating passageway 510 is a generally cylindrically shaped passageway extending between an upper opening 512 and an exterior port 514. In addition, lower housing section 506 includes a plurality of interior ports 516 that provide fluid communication between internal passageway 508 and circulating passageway 510. Together, exterior port 514, interior ports 516 and circulating passageway 510 form a fluid flow path 520 between internal passageway 508 and an annulus 518 surrounding housing 502. Circulating valve 500 may include an optional removable barrier 522 positioned within fluid flow path 520 to initially prevent fluid flow between exterior port 514 and interior ports 516.

In the illustrated embodiment, upper housing section 504 includes a cylindrical passageway 524 that is in fluid communication with internal passageway 508 via one or more ports 526. A piston 528 is positioned within cylindrical passageway 524 and extends into circulating passageway 510. A seal plug 530 is positioned within circulating passageway 510. Seal plug 530 includes a generally cylindrical plug shell 532 having a thin walled section including a plurality of annular grooves forming a plurality of annular lands referred to herein as seal rings as described above. Seal plug 530 also includes a generally cylindrical plug pin 536 that is operable to be slidably received in plug shell 532. Plug pin 536 is also slidably received about a plug sleeve 538 disposed within plug shell 532. Preferably, plug pin 536 has an interference fit with plug sleeve 538 or may be coupled thereto with a bonding agent to prevent premature setting of seal plug 530. Plug pin 536 may have a slight taper to aid in insertion of plug pin 536 into plug shell 532 and to enable expansion of the seal rings as plug pin 536 is inserted into plug shell 532, as described below.

Circulating valve 500 may be operated responsive to a local pressure event within cylindrical passageway 524 initiated by a pressure signal. In the illustrated embodiment, a pressure sensor 542 is disposed within cylindrical passageway 524 and is operable to receive and interpret pressure signals sent from the surface. For example, by applying a predetermined number and sequence of fluid pressure fluctuations to internal passageway 508 via the tubing string from the surface, pressure sensor 542 receives the signal from the fluid in internal passageway 508 via fluid port 526. When pressure sensor 542 receives the proper pressure signature, pressure sensor 542 sends a signal to logic module 544 to begin the activation process. Even though the signal for initiating the setting of seal plug 530 has been described as a pressure signal received by a pressure sensor, those skilled in the art will understand the other types of signals both wireless and wired could alternatively be used including, but not limited to, acoustic signals, electromagnetic signals, hydraulic signals, electrical signals, optical signals and the like, such signals being received and interpreted by the corresponding type of receiver.

Logic module 544 receives the activation signal from pressure sensor 542 and causes a current to be sent to ignition agent 546. Logic module 544 may include various controllers, processors, memory components, operating systems, instructions, communication protocols and the like. As should be understood by those skilled in the art, any of the functions described with reference to logic module 544 herein can be implemented using software, firmware, hardware, including fixed logic circuitry or a combination of these implementations. As such, the term logic module as used herein generally represents software, hardware or a combination of software and hardware. For example, in the case of a software implementation, the term logic module represents program code and/or declarative content, e.g., markup language content that performs specified tasks when executed on a processing device or devices such as one or more processors or CPUs. The program code can be stored in one or more computer readable memory devices. More generally, the functionality of the illustrated logic module may be implemented as distinct units in separate physical grouping or can correspond to a conceptual allocation of different tasks performed by a single software program and/or hardware unit.

Batteries (not pictured) may be used to power the electronic devices such as pressure sensor 542 and logic module 544. In addition, the batteries may be used to provide suitable current to initiate the combustion of combustible element 548. The batteries may be of any suitable type such as alkaline batteries that provide sufficient power and current and are capable of withstanding the temperature in the well environment.

In the illustrated embodiment, ignition agent 546 may be a metal burning fuse such as a magnesium fuse which is activated by the electrical current supplied from the batteries in response to the activation signal. Metal fuses are preferred as metals burn without releasing cooling gases and can burn at extremely high temperatures. Magnesium fuses are most preferred as due to the reactive nature of magnesium and temperature at which magnesium burn which is sufficiently high to ignite combustible agent 548. Alternatively, a nichrome wire such as a NiCr60 wire, may be used to directly ignite combustible agent 548. As another alternative, a nichrome wire may be used in an ignition train to ignite a metal burning fuse which in turn ignites combustible agent 548. In this case, both the nichrome wire and the metal burning fuse may be considered to be an ignition agent.

Combustible agent 548 may be a propellant or other substance or mixture that has the capacity for extremely rapid but controlled combustion that produces a combustion event including the production of a large volume of gas at high temperature and pressure. Combustible agent 548 is preferably a solid but may be a liquid or combination thereof. In an exemplary embodiment, combustible agent 548 comprises a solid propellant such as nitrocellulose plasticized with nitroglycerin or various phthalates and inorganic salts suspended in a plastic or synthetic rubber and containing a finely divided metal. Moreover, in this exemplary embodiment, combustible agent 548 may comprise inorganic oxidizers such as ammonium and potassium nitrates and perchlorates. Most preferably, potassium perchlorate is employed. It should be appreciated, however, that substances other than propellants may be utilized as combustible agent 548 including, but not limited to, a composition of a metal powder and a metal oxide that produces an exothermic chemical reaction.

In operation, after circulating valve 500 has been run downhole as part of a tubing string and it is desired to circulate fluid between internal passageway 508 and annulus 518, removable barrier 522, if present, may be actuated. Thereafter, a fluid may be pumped from the earth's surface down through the tubing string into internal passageway 508, through fluid flow path 520 and into annulus 518 for return to the surface. When it is desired to operate circulating valve 500 from the circulating configuration (FIG. 6A) to the non-circulating configuration (FIG. 6B), the pressure signal may be sent from the surface and received by pressure sensor 542. Pressure sensor 542 then sends an activation signal to logic module 544. After processing the activation signal, logic module 544 causes a current to be sent to ignition agent 546 which in turn cause ignition of combustible agent 548. The combustion of combustible agent 548 produces a large volume of gas which pressurizes cylindrical passageway 524. As one skilled in the art will also appreciate, the combustion of combustible agent 548 is an exothermic oxidation reaction that yields large volumes of gaseous end products of oxides at high pressure and temperature. In particular, the volume of oxides created by the combustion of combustible agent 548 within cylindrical passageway 524 provides the force required to actuate piston 528. Specifically, the force shifts piston 528 downwardly which drives seal plug 530 through circulating passageway 510 until plug shell 532 contacts annular shoulder 540 of circulating passageway 510 such that seal plug 530 is in a position between exterior port 514 and interior ports 516 in fluid flow path 520. Further downward movement of piston 528 shifts plug pin 536 down plug sleeve 538 and into plug shell 532 which causes the expansion of the seal rings forming a plurality of metal-to-metal seals with circulating passageway 510, thereby preventing fluid flow through fluid flow path 520.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole circulating valve comprising:

a generally tubular outer housing comprising an internal passageway, at least one circulating passageway formed through at least a portion of the housing, at least one exterior port in fluid communication with the circulating passageway, and at least one interior port in fluid communication with the circulating passageway and the internal passageway; and at least one seal plug disposed within the circulating passageway, the seal plug comprising a plug shell having at least one seal ring and a plug pin operable to be received within the plug shell to expand the seal ring, the seal plug being actuable between a first position, in which the seal plug is remote from the interior and exterior ports so that fluid flow is allowed between the interior and exterior ports through the circulating passageway, and a second position, in which the seal plug is positioned between the interior and exterior ports and the plug pin is received within the plug shell so that the seal ring is expanded to form a metal-to-metal seal with the circulating passageway, thereby preventing fluid flow between the interior and exterior ports.

2. The downhole circulating valve as recited in claim 1 further comprising a piston at least partially disposed within the circulating passageway and operably associated with the seal plug, wherein longitudinal shifting of the piston in a first direction operates the seal plug from the first position to the second position.

3. The downhole circulating valve as recited in claim 1 wherein the seal plug further comprises a plurality of seal rings each forming a metal-to-metal seal with the circulating passageway when the seal plug is in the second position.

4. The downhole circulating valve as recited in claim 1 wherein the seal plug forms multiple metal-to-metal seals with the circulating passageway when the seal plug is in the second position.

5. The downhole circulating valve as recited in claim 1 further comprising multiple seal plugs disposed within the circulating passageway wherein each of the seal plugs forms at least one metal-to-metal seal with the circulating passageway when the seal plugs are positioned between the exterior port and the interior port.

6. The downhole circulating valve as recited in claim 1 further comprising multiple seal plugs disposed within the circulating passageway wherein each of the seal plugs forms multiple metal-to-metal seals with the circulating passageway when the seal plugs are positioned between the exterior port and the interior port.

7. The downhole circulating valve as recited in claim 1 further comprising a removable barrier disposed within a fluid flow path between the exterior port and the interior port to initially prevent fluid flow between the exterior port and the interior port.

8. A method for operating a downhole circulating valve, the method comprising:

providing a circulating valve, the circulating valve comprising:

a generally tubular outer housing comprising an internal passageway, at least one circulating passageway formed through at least a portion of the housing, at least one exterior port in fluid communication with the circulating passageway, and at least one interior port in fluid communication with the circulating passageway and the internal passageway; and at least one seal plug disposed within the circulating passageway, the seal plug comprising a plug shell having at least one seal ring and a plug pin operable to be received within the plug shell to expand the seal ring;

running the circulating valve into a wellbore on a tubular string;

shifting the seal plug from a first position, in which the seal plug is remote from the interior and exterior ports so that fluid flow is allowed between the interior and exterior ports through the circulating passageway, to a second position, in which the seal plug is positioned between the interior and exterior ports; and receiving the plug pin within the plug shell so that the seal ring is expanded to form at least one metal-to-metal seal with the circulating passageway, thereby preventing fluid flow between the interior and exterior ports.

9. The method as recited in claim 8 further comprising initially preventing fluid flow between the exterior port and the interior port with a removable barrier.

10. The method as recited in claim 8 further comprising initially preventing fluid flow between the exterior port and the interior port with a rupture disk and increasing a pressure signal acting on the rupture disk to burst the rupture disk and allow fluid flow between the exterior port and the interior port.

11. The method as recited in claim 8 wherein receiving the plug pin within the plug shell so that the seal ring is expanded to form at least one metal-to-metal seal with the circulating passageway further comprises forming multiple metal-to-metal seals with the circulating passageway.

12. The method as recited in claim 8, wherein shifting the seal plug from the first position to the second position further comprises shifting multiple seal plugs; and wherein receiving the plug pin within the plug shell so that the seal ring is expanded to form at least one metal-to-metal seal with the circulating passageway further comprises forming at least one metal-to-metal seal with each of the seal plugs and the circulating passageway.

13. The method as recited in claim 8, wherein shifting the seal plug from the first position to the second position further comprises shifting multiple seal plugs; and wherein receiving the plug pin within the plug shell so that the seal ring is expanded to form at least one metal-to-metal seal with the circulating passageway further comprises forming multiple metal-to-metal seals between each seal plug and the circulating passageway.

14. A downhole circulating valve comprising:

a generally tubular outer housing comprising an internal passageway, at least one circulating passageway formed through at least a portion of the housing, at least one exterior port, and at least one interior port, the exterior port, the interior port, and at least a portion of the circulating passageway forming a fluid flow path through the housing;

at least one seal plug disposed within the circulating passageway, the seal plug comprising a plug shell having at least one seal ring and a plug pin operable to be received within the plug shell to expand the seal ring, the seal plug being actuable between a first position, in which the seal plug is remote from the interior and exterior ports so that fluid flow is allowed through the fluid flow path, and a second position, in which the seal plug is positioned between the interior and exterior ports and the plug pin is received within the plug shell so that the seal ring is expanded to form at least one metal-to-metal seal with the circulating passageway, thereby preventing fluid flow through the fluid flow path.

15. The downhole circulating valve as recited in claim 14 wherein the seal plug forms multiple metal-to-metal seals with the circulating passageway when the seal plug is in the second position.

16. The downhole circulating valve as recited in claim 14 further comprising multiple seal plugs disposed within the circulating passageway wherein each of the seal plugs forms at least one metal-to-metal seal with the circulating passageway when the seal plugs are positioned between the exterior port and the interior port.

17. The downhole circulating valve as recited in claim 14 further comprising multiple seal plugs disposed within the circulating passageway wherein each of the seal plugs forms multiple metal-to-metal seals with the circulating passageway when the seal plugs are positioned between the exterior port and the interior port.

18. The downhole circulating valve as recited in claim 14 further comprising:

a piston at least partially disposed within the circulating passageway and operably associated with the seal plug; and an actuator sleeve slidably disposed within the internal passageway and operably associated with the piston so that shifting the actuator sleeve in a first direction shifts the piston in the first direction and actuates the seal plug from the first position to the second position.

19. The downhole circulating valve as recited in claim 18 wherein the removable barrier further comprises a rupture disk.

20. The downhole circulating valve as recited in claim 14 further comprising a removable barrier disposed within the fluid flow path to initially prevent fluid flow through the fluid flow path.

* * * * *